US005509340A

United States Patent [19]

Kawamura

[11] Patent Number: 5,509,340

[45] Date of Patent: Apr. 23, 1996

[54] METHOD FOR ADJUSTMENT OF HAMMER LET OFF ON A KEYBOARD MUSICAL INSTRUMENT

[75] Inventor: Kiyoshi Kawamura, Hamamatsu, Japan

[73] Assignee: Yamaha Corporation, Japan

[21] Appl. No.: 345,497

[22] Filed: Nov. 28, 1994

[30] Foreign Application Priority Data

Dec. 27, 1993 [JP] Japan ..... 5-347215

[51] Int. Cl.[6] ..... G10C 3/18

[52] U.S. Cl. ..... 84/236; 84/243

[58] Field of Search ..... 84/221, 236, 237, 84/240, 744, DIG. 7

[56] References Cited

U.S. PATENT DOCUMENTS 782,799 11/1904 Smith ..... 84/236

4,879,939 11/1989 Wall ..... 84/240

5,374,775 12/1994 Kawamura et al. ..... 84/236 X 5,386,083 1/1995 Kawamura ..... 84/719

FOREIGN PATENT DOCUMENTS 5-341774 12/1993 Japan .

*Primary Examiner*—Steven L. Stephan

*Assistant Examiner*—Patrick J. Stanzione

*Attorney, Agent, or Firm*—Graham & James

[57] ABSTRACT

On a keyboard musical instrument provided with action assemblies each including a catcher and silent assemblies each including a stopper, the real silent distance between each catcher and an associated stopper is measured to calculate its difference from the optimal silent distance, and one or more attachments are added to or one or more components are removed from either of the two elements depending on the polarity of the difference in silent distance in order to minimize the let off distance of each hammer relative to an associated string.

8 Claims, 8 Drawing Sheets

METHOD FOR ADJUSTMENT OF HAMMER LET OFF ON A KEYBOARD MUSICAL INSTRUMENT

BACKGROUND OF THE INVENTION

The present invention relates to method for adjustment of hammer let off on a keyboard musical instrument, and more particularly relates to method for minimizing the hammer let off distance on a keyboard musical instrument provided with a plurality of action assemblies each including a swingable catcher and a hammer adapted for striking an associated string, and a mute assembly including a stopper adapted for prohibiting continued swing of said catchers just before string striking by the hammers.

Various type of pianos have recently been developed in the field of keyboard musical instruments, which are provided with silent systems in addition to the conventional muffler systems. A muffler system is used for buff citing string sounds once generated by string striking whereas a silent system is used for prohibiting generation of string sounds themselves. More specifically in the case of a silent system, each action assembly is driven for operation in response to key operation. However, continued swing of a hammer in the action assembly is prohibited just before striking an associated string. In a typical arrangement of such a silent system, a silent assembly includes a stopper which intercepts continue swing of a catcher related in action to an associated hammer via a butt of a hammer assembly. Such a silent system is disclosed in Japanese Patent Application Hei. 4-174807 filed in 1992 by the applicant of the present invention. Use of such silent system allows normal performance and silent performance on keyboard musical instruments. Even during silent performance, musical sounds can be generated in electronic fashion for the convenience of players though no string sounds are generated in a mechanical fashion.

Silent system, however, is inevitably accompanied with degradation in key touch feel. In order to prohibit generation of string sound, the above-described stopper in the silent assembly needs to be moved towards a hammer shank in the hammer assembly. Here, a term "let off distance D" refers to the distance between a hammer and an associated string at a moment when the hammer gets out of operation by a jack and starts to swing freely. In the case of an conventional piano, the value of the let off distance D is 3 mm for the bass range, 2.5 mm for the middle range and 2 mm for the treble range.

When the let off distance for silent performance is set to a value equal to that on the conventional piano, the butt of the hammer assembly is clamped between a jack and a stopper of tile silent assembly before disengagement of the jack from the butt. As a result, piano performance such as tremolo performance cannot be carried out. In order to avoid such a trouble, it is necessary to reduce the distance between the jack tail of the hammer assembly and a regulating button on a center rail in order to allow earlier disengagement of the jack from the butt. This adjustment inevitably causes increased let off distance D. For example, the let off distance D is increased up to 10 mm or larger. Such a significant increase in let off distance causes corresponding change in key touch feel. In addition, advanced disengagement of the jack reduces energy to be supplied from the jack to the butt and, as a consequence, reduces striking power of the hammer during normal performance, thereby causing generation of music sounds of softer tone colours than normal.

Variation in height of catchers, i.e., positional variation of catchers relating to variation in angle between catchers and hammers or shanks wields a great, malign influence on silent performance. In the case of general pianos, the variation in height of catchers is in a range of ±1 mm and a variation of this extent has no substantial malign influence on normal performance. That is, the variation can be disregarded in the case of normal performance by using a mute system with a catcher stopper. The variation of this extent, however, wields a great influence on key touch in the case of silent performance. The ratio in swing movement of a catcher with respect to an associated hammer is generally in a range from 2 to 3. So, when swing movement of a catcher is prohibited by a stopper just before a hammer strikes an associated string, variation in height of the catcher is amplified by 2 to 3 times on the side of the hammer. For example, when variation in height of the catcher is in a range of ±1 mm, resultant variation in position of the hammer is in a range of ±3 mm. Let off position of the hammer must be determined based on the largest value of the positional variation of the hammer when the hammer swing is prohibite.

In consideration of such a background, the let off distance is usually set to a value somewhat larger than the largest value on a keyboard musical instrument incorporating a conventional silent assembly. As a result, the let off distance D with the conventional silent assembly is designed inavoidably too large to assure comfortable key touch feel.

In an attempt to avoid such a design, it is proposed to mount a stopper to a supporter via screw engagement so that the position of the stopper relative to an associated catcher can be adjusted by screw turning. In this way, the let off distance D of a hammer for silent performance can be made very close to that for normal performance in order to minimize degradation in key touch feel. This solution, however, necessitates delicate stopper position adjustment for all keys on the keyboard and, as a consequence, entails much time and labour. In addition, inevitable generation of vibrations during performance tends to disturb screw adjustment and, as a consequence, reproduces variation in stopper height.

SUMMARY OF THE INVENTION

It is the basic object of the present invention to minimize the let off distance for all the keys in the keyboard.

It is the other object of the present invention to provide a method for adjustment of hammer let off which can well endure vibrations during performance for a long period.

In accordance with the basic aspect of the present invention, the real silent distance between each catcher and an associated stopper is measured to calculate its difference from the optimal silent distance and one or more attachments are added to or one or more components are removed from either of the catcher and the stopper depending on the polarity of the difference in silent distance. When the real silent distance is larger than the optimal silent distance, the attachments are added whereas the components are removed when the real silent distance is smaller than the optimal silent distance.

There is a linear relationship between the let off distance (D) and the optimal silent distance (Y), which is defined by the following equation;

$$47=3Y+D$$

So, in order to minimize the let off distance (D), it is necessary to minimize the optimal silent distance (Y). In order to obtain such a result, the real silent distances for all keys must be made close to the optimal silent distance.

In accordance with one aspect of the present invention, a real silent distance between each catcher and a stopper is measured to calculate a difference between the real silent distance and the optical silent distance. Each catcher whose real silent distance is larger than the optimal silent distance is sorted out and the operating face of the sorted catcher is covered with an adjuster strap of a thickness equal to the difference in silent distance.

In accordance with another aspect of the present invention, a real silent distance between catch catcher and a stopper is measured to calculate a difference; between the real silent distance and the optimal silent distance. Each catcher whose real silent distance is smaller than the optimal silent distance is sorted out and the operating face of the sorted catcher is removed over a depth equal to the difference in silent distance.

In accordance with the other aspect of the present invention, real silent distances between catchers and a stopper is measured to calculate differences between the real silent distances and the optimal silent distance. Catchers of the first group whose real silent distances are larger than the optimal silent distance are sorted out and catchers of the second group whose real silent distances are smaller than the optimal silent distance are also sorted out. Operating faces of the catchers of the first group are covered with straps of thicknesses equal to corresponding differences in silent distance whereas operating faces of the catchers of the second group are removed over depths equal to corresponding differences in silent distance.

In accordance with a still other aspect of the present invention, a real silent distance "between each catcher and a stopper is measured to calculate a difference between the real silent distance and the optimal silent distance. Each catcher whose real silent distance is larger than the optimal silent distance is sorted out and an adjuster strap of a thickness equal to the difference in silent distance is added to a section on the catcher which corresponds to the sorted catcher.

In accordance with a still other aspect of the present invention, a stopper is divided at least partially into a plurality of juxtaposed initial segments each corresponding to each catcher. A real silent distance between each catcher and the stopper is measured to calculate a difference between the real silent distance and the optimal silent distance. Each catcher whose real silent distance is larger than the optimal silent distance is sorted out and the initial segment corresponding to a sorted catcher is interchanged with a new segment of a thicker construction, a difference in thickness between the initial and new segments being equal to the difference in silent distance.

In accordance with a still other aspect of the present invention, a stopper is divided at least partially into a plurality of juxtaposed initial segments each corresponding to each catcher. A real silent distance between each catcher and the stopper is measured to calculate a difference between the real silent distance and the optimal silent distance. Each catcher whose real silent distance is smaller than the optimal silent distance is sorted out and the initial segment corresponding to a sorted catcher is interchanged with a new segment of a thinner construction, a difference in thickness bet;ween the initial and new segments being equal to the difference in silent distance.

In accordance with a still other aspect of the present invention, a stopper is divided into a plurality of juxtaposed initial segments each corresponding to each catcher. Real silent distances between the catchers and the stopper are measured to calculate differences between the real silent distances and the optimal silent distance. Catchers of the first group whose real silent distances are larger than the optimal silent distance are sorted out and catcher of the second group whose real silent distances are smaller than the optimal silent distance are also sorted out. The initial segments corresponding to the sorted catchers of the first group are interchanged with new segments of thicker constructions whereas the initial segments corresponding to the sorted catchers of the second group are interchanged with new segments of thinner constructions, differences in thickness between the initial segments and the new segments being equal to the differences in silent distance, respectively.

In accordance with a still other aspect of the present invention, real silent distances between catchers and a stopper are measured and all of the real silent distances are adjusted to one of the maximum and minimum real silent distances so that all the catchers should have a uniform real silent distance. The stopper is moved relative to a raw of the catchers to make the uniform real silent distance equal to the optimal silent distance.

DESCRIPTION OF THE PREFERRED EMBODIMENTS

Figure 1:
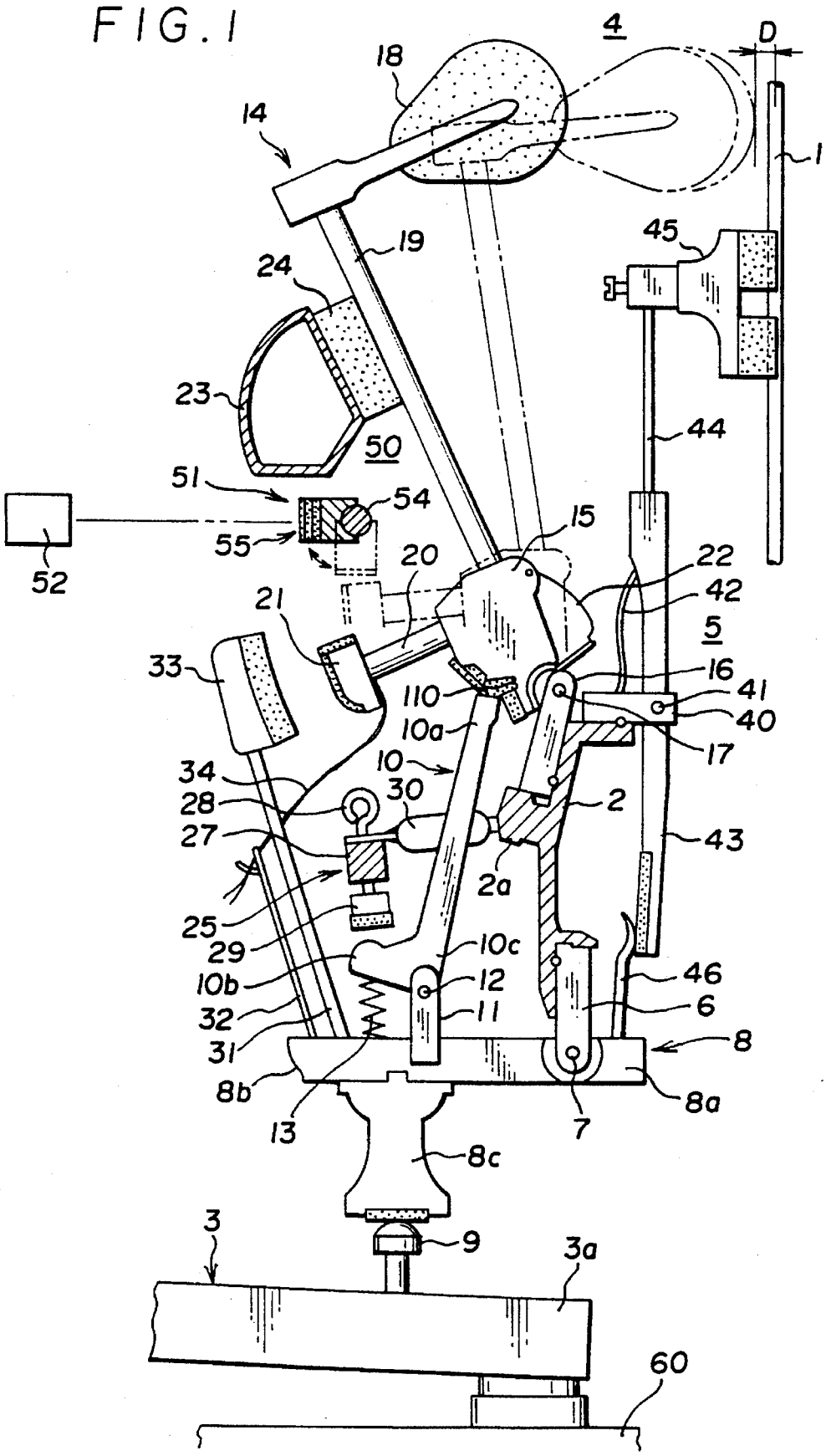
FIG. 1 is a side view, partly in section, of one example of the main part of an upright piano on which the present invention is carried out.
Figure 2:
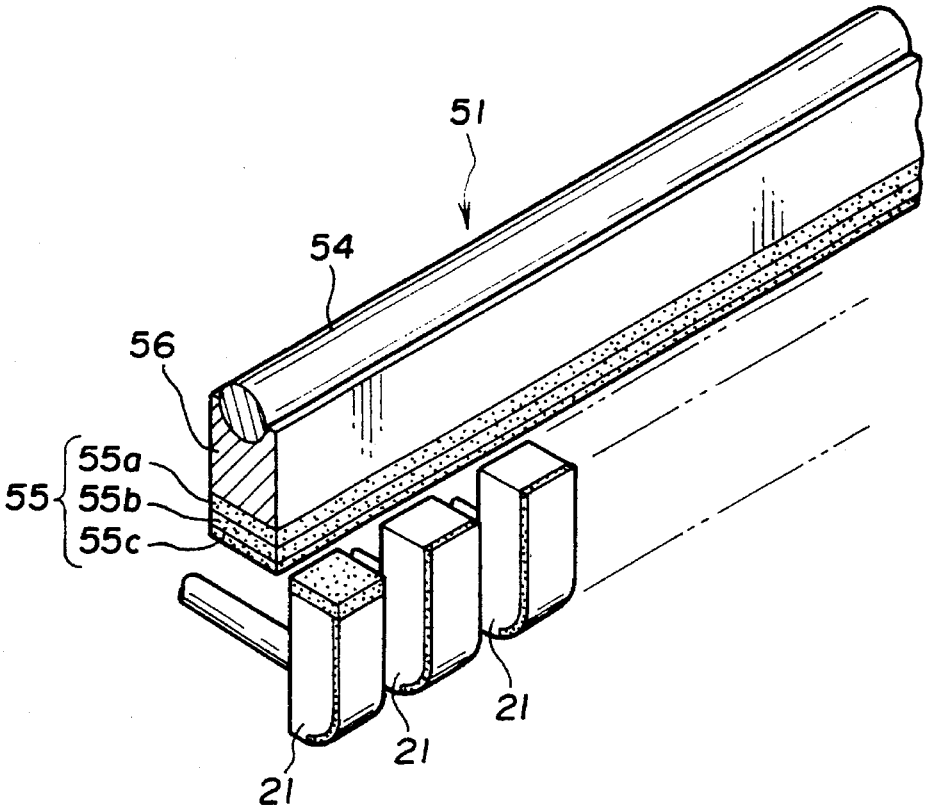
FIG. 2 is a perspective view of a silent assembly used for the upright piano shown in FIG. 1.
Figure 3:
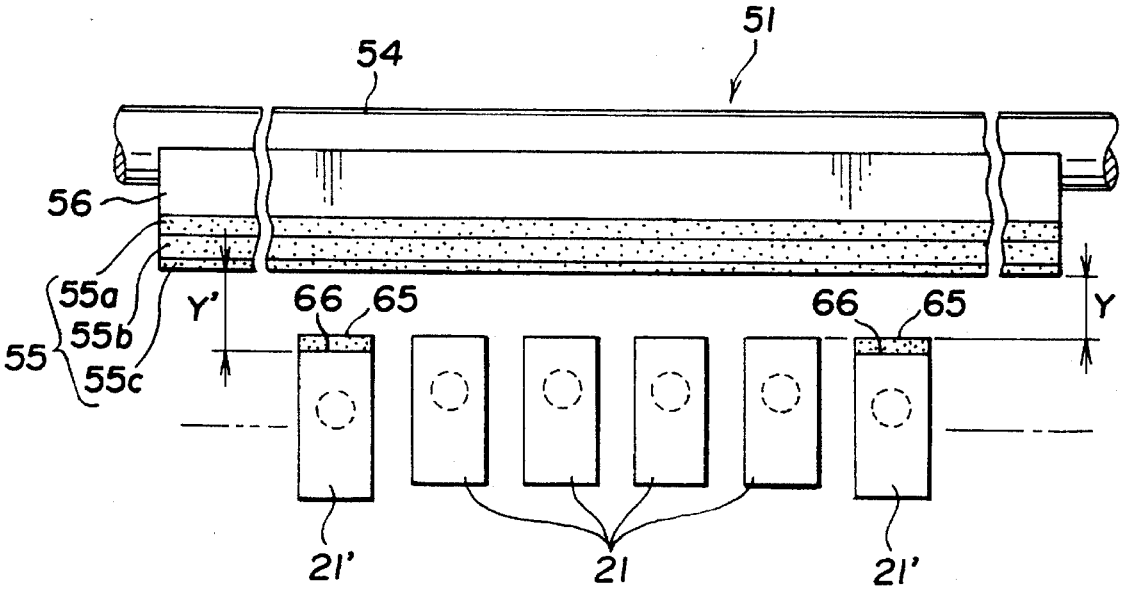
FIG. 3 is a top view of the silent assembly shown in FIG. 2, FIGS. 4A to 4C are perspective views of various attachments to be added to a catcher in accordance with the present invention.

One example of the action assembly on an upright piano to which the present invention is advantageously applied is show in FIGS. 1 to 3 under a condition during normal performance.

In the arrangement illustrated in FIG. 1 each string 1 is secured at both ends via tuning and frame pins to a frame (not shown) while extending substantially vertically under a prescribed tension. On the front side of the strings 1, a center rail 2 common to all the strings 1 extends horizontally and transversely at a position somewhat above the rear end 3*a* of each key 3. The center rail 2 carries an action assembly 4 and a damper assembly 5. The action assembly 4 strikes an associated string 1 in response to an operation on the key 3.

The action assembly 4 includes a wippen 8 which in the longitudinal direction of the key 3 at a position below the center rail 2. A wippen flange 6 fixed to the lower end of the center rail 2 is pivoted via a center pin 7 to the rear end 8*a* of the wippen 8. A wippen heel 8*c* is secured to the lower side of the front end 8*a* of the wippen 8 and rests on a capstan 9 secured to the upper face of an associated key 3 in order to keep the wippen 8 in a substantially horizontal position under the normal condition.

A jack 10 is arranged above,the middle of the wippen 8. More specifically, the jack 10 has an L-shaped configuration with its lower branch 10*b* extending forwards. At an apex 10*c*, the jack 10 is pivoted via a center pin 12 to the upper end of a jack flange 11 which is secured at the lower end to the upper face of the wippen 8. A jack spring 13 is interposed between the lower branch 10*b* of the jack 10 and the wippen 8 in order to urge the upper branch 10*a* of the jack 10 to swing forwards. The upper end 110 of the upper branch 10*a* of the jack 10 abuts against the lower face of a butt 15 of a hammer assembly 14.

A butt flange 16 is secured to the front face of the center rail 2 and the butt 15 of the hammer assembly 14 is pivoted via a center pin 17 to the upper end of the butt flange 16. The butt 15 carries a hammer shank 19 which extends upwards in order to hold a hammer 18 in front of an associated string 1. A catcher shank 20 extends forwards from the butt 15 to hold a catch 21 in front of the butt 15. The butt 15 is further associated with a butt spring 22 which urges the butt 15 to swing rearwards about the center pin 17. A hammer rail 23 associated with a felt 24 extends horizontally and transversely at a position in front of the hammer assembly. Under the normal condition, each hammer shank 19 is held at the initial position in contact with the hammer rail 23.

When the key 3 is operated during normal performance, the wippen 8 is pushed up via the capstan 9 and swings upwards about the center pin 7. Then, the jack 10 pushes up the butt 15 and the hammer assembly 14 swings rearwards so that the hammer 18 strikes a string 1 corresponding the operated key 3. During lifting movement of the jack 10, its lower branch 10B abuts against a regulating assembly 25 which limits the lifting movement of the jack 10. Due to this abutment against the regulating assembly 25, the jack 10 is driven for forward swing against operation of the jack spring 13 so, that the upper end of the jack 10 just provisionally disengages from the butt 15. The distance D between the hammer 18 and the string 1 at the moment of this disengagement is called "an let off distance" as stated above. As the operation on the key 3 is cancelled, the wippen 8 swings downwards about the center pin 7 and the upper end of the jack 10 again comes into engagement with the butt 15 due to operation of the jack spring 13 for tile subsequent string striking.

The regulating assembly 25 includes a plurality of horizontal and transverse regulating rails 27 each of which covers a plurality of juxtaposed action assemblies 4. That is, 88 sets of action assemblies 4 are grouped into a plurality of sections. The regulating assembly 25 further includes a plurality of regulating buttons 29 each of which is mounted via a regulating screw 28 to an associated regulating rail 27 whilst facing the lower branch 10B of an associated jack 10. Each regulating rail 27 is connected to the center rail 2 by means of a regulating bracket 30 which is kept in screw engagement with a front projection 2*a* on the center rail 2.

Near the front end 8*b*, a back check wire 31 and a bridle wire 32 are mounted on the wippen 8 whilst extending upwards towards the catcher 21 on the butt 15. The two wires 31 and 32 are somewhat inclined forwards. A back check 33 is held atop the back check wire 31 in order to elastically accept the catcher 21 when hammer assembly 14 swing forwards after striking an associated string 1. The catcher 21 is connected to the bridle wire 32 by a bridle tape 34 so that the swing movement of the hammer assembly 14 should follow that of the wippen 8. This connection also prevents undesirable bounce of the hammer assembly 14, double striking of the string 1 and accelerated return of the hammer assembly 14 to its initial position.

The above-described damper assembly 5 includes a damper lever flange 40, a damper lever 43 and a damper 45 mounted via a damper wire 44 atop the damper lever 43. The damper lever flange 40 is mounted to the top end of the center rail 2 and projects somewhat rearwards. The damper lever 43 is pivoted at about its middle to the damper lever flange 40 via a center pin 41 and urged to swing rearwards due to operation of a damper lever spring 42 which is interposed between the upper section of the damper lever 43 and the damper lever flange 40. A damper spoon 46 is arranged on the rear end 8*a* of the wippen 8 in contact with the damper lever 43.

Normally, the damper 45 is kept in pressure contact with an associated string 1 due to operation by the damper lever spring 42 to prohibit free vibration of the string 1. When the associated key 3 is operated, the wippen 8 swings upwards about the center pin 7 and the damper spoon 46 on the wippen 8 urges the damper lever 43 to swing forwards against the operation of the clamper lever spring 42 so that the damper 45 should escape from the pressure contact with the string 1. Instantly thereafter, the hammer 18 strikes the string 1 for normal performance.

The arrangements and operations of the above-described action assembly 4 and damper assembly 5 are same as those of like conventional assemblies on an upright piano.

The silent performance system in accordance with the present invention on an upright piano includes, in addition to the above-described action assembly 4 and damper assembly 5, a silent assembly 50 which prohibits generation of string sounds without any degradation in key touch feel. That is, the silent assembly 50 prohibits continued swing of the catcher 21 of the hammer assembly 14 just before the hammer 18 strikes an associated string 1 during silent performance. The silent assembly 50 includes a stopper 51 arranged above the catcher 21 and a switch mechanism 52 to switch the condition of the stopper 51 between normal performance and silent performance and vice versa.

More specifically, the silent assembly 50 includes, as shown in FIGS. 2 and 3, a rotary silent shaft 54 which extends horizontally and transversely to cover all the strings 1. The silent shaft 54 is provided with a buffer unit 55 secured thereto via radially extending buffer base 56. The buffer unit 55 covers all the strings 1 and has a laminated construction in order to provide key touch feel of normal performance even during silent performance. That is, the buffer unit 55 includes the first buffer strap 55*a*, the second buffer strap 55*b* softer than the first one and a protector strap 55*c* made of leather or resin films, the buffer base 56 is preferably made of wood or steel.

The switch mechanism 52 may be given in any form as long as it can drive the silent shaft 54 for rotation. For example, it may take the form of a manual lever, a drive motor or a solenoid connected in operation to one end of the silent shaft. Such a manual lever may be properly arranged below a key frame 60 in FIG. 1 and connected via a wire to one end of the silent shaft 54. When a drive motor is employed, the drive motor may be coupled via proper gearing to one lend of the silent shaft 54.

For transit between normal performance and silent performance the silent shaft 54 is driven for rotation over a prescribed angle by operation of the switch mechanism 52. The silent shaft 54 is rotatably mounted to the frame of the piano (not shown) by proper bearings.

During normal performance, the buffer unit 55 is directed horizontally forwards as shown with solid lines in FIG. 1. In this position, the buffer unit 55 stays out of the moving ambit of the catcher 21 of the hammer assembly 14. As the action assembly 4 swings on key operation, the catcher 21 does not abut against the stopper 51 and, as a consequence, the hammer 18 strikes an associated string 1 for sound generation in a normal fashion.

When shifted into silent performance, the buffer unit 55 is directed vertically downwards as shown with chain lines in FIG. 1. In this position, the buffer unit 55 intrudes into the moving ambit of the catcher 21 of the hammer assembly 14. As the action assembly 4 swings on key operation, the catcher 21 abuts against the stopper 51 and, as a consequence, the hammer 18 does not strike the associated string 1.

Though not illustrated in the drawings, the silent performance system may further include key switchs and a sound source unit. Each key switch is arranged below an associated key and electrically connected to the sound source unit. When the key is operated, its associated key switch issues a key output signal which is passed to the sound source unit. The sound source unit then produces a corresponding sound in an electronic mode. Thus, though the string 1 is not stricken by the hammer 18 during silent performance, a corresponding sound can be generated by electronic processing of the key output signals when required.

The above-described mechanism of silent performance will now be described in more detail in reference to FIGS. 1 and 3. When the stopper 51 assumes the vertical position for silent performance as shown with chain lines in FIG. 1, a distance between the catcher 21 and the stopper 51 is set to a value which results in the minimum value of the let off distance D (see FIG. 1). This distance Y (see FIG. 3) is called "an optimal silent distance".

As a key 3 is operated with this optimal distance Y at the stopper 51, the capstan 9 on the key 3 drive the wippen 8 for upward swing about the center pin 7, the jack 10 moves upwards to push up the butt 15 and the hammer assembly 14 swings rearwards. Following lift of the jack 10, it lower branch 10*b* abuts against the regulating button 29, further lift of the jack 10 is prohibited and the upper end of the jack 10 escapes out of abutment against the butt 15 of the hammer assembly 14. The system is arranged so that this escape of the jack 10 should occur when the hammer 18 is at a distance of 3 to 8 mm from an associated string 1. At this movement, manual force acting on the key 3 is very close to that during normal performance.

As the butt 15 is pushed up by lift of the jack 10, the hammer assembly 14 swings rearwards to strike the string 1. Just before striking of the string 1 by the hammer 18, the catcher 21 abuts against the stopper 51 and its further movement is prohibited. The hammer assembly 14 is not allowed to swing over an angle sufficient for striking the string 1. Then, operation of the butt spring 22 forces the hammer assembly 14 to return to its initial position. Reaction of the abutment of the catcher 21 against the stopper 51 also assists this reverse movement of the hammer assembly 14. Following the reverse movement of the wippen 8, the jack 10 again swings rearwards to come into engagement with the butt 15. The initial position of the system is thus resumed and silent performance is thus completed.

In the arrangement shown in FIG. 3, the real silent distance Y' between the catcher 21 and the stopper 51 varies from key to key over a range of about ±1 mm. This difference in real silent distance Y' causes corresponding difference in extent of swing of the catcher 21 and the hammer 18. Stated otherwise, variation in real silent distance Y' wields a great influence on the let off distance D and, as a consequence, causes undesirable degradation in key touch feel. It is thus strongly required to minimize the variation in real silent distance Y' between the catcher 21 and the stopper 51. Stated otherwise, the real silent distance Y' should be adjusted as close to the optimal silent distance Y as possible in order to minimize the let off distance D.

The following processes are employable to this end;

(1) Adjustment through addition of an attachment or attachments to the catcher 21.

(2) Adjustment through change in configuration of the catcher 21.

(3) Adjustment through addition of an attachment or attachments to the stopper 51.

(4) Adjustment through partial interchange of a buffer element for the stopper 51.

(5) Adjustment through change in distance between the catcher 21 and the stopper 51.

The first type of adjustment will now be described in reference to FIGS. 2 and 3, in which one or more attachments are added to the catcher 21. In the case of this process, the real distance Y' between the catcher 21 and the stopper 51 is first measured and catchers 21' with a real silent distance Y' larger than the optimal silent distance Y are picked up. For each catcher 21' of that group, an adjuster strap 65 is added to the operating face 66 of the catcher 21' suited for abutment against the stopper 51. In this case, the adjuster strap 65 has a thickness equal to the difference in silent distance (Y'—Y). The resultant, effective distance between the catcher 21 and the stopper 51 is now equal to the optimal silent distance Y which minimizes the let off distance D.

A light and endurable material is preferably used for the adjuster strap 65 in order to minimize increase in weight of the action assembly 4. In practice, the adjuster strap 65 is given in the form of a planar chip made of wood, resin or aluminum and is bonded to the operating face of the catcher 21.

Figure 4A:
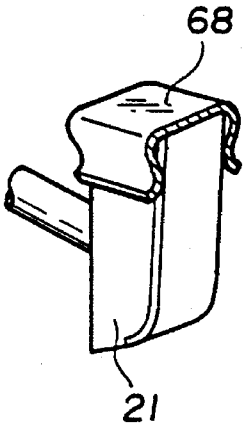
Figure 4B:
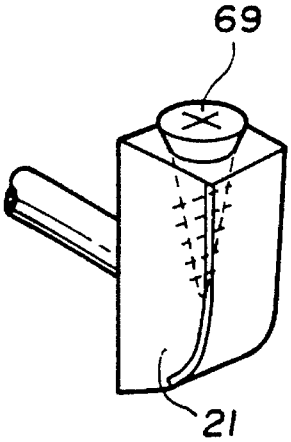
Figure 4C:
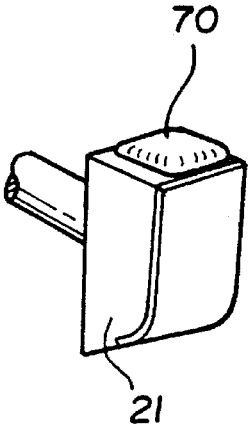

In an alternative shown in FIG. 4A, a clip 68 made of a spring material is fitted to the operating face of the catcher 21 and secured by a bond. In the example shown in FIG. 4B, a conical screw 69 is screwed into the operating face of the catcher 21 and secured by bond. A planer resin piece 70 may be bonded to the operating face of the catcher 21. In this case, urethane resins, epoxy resins or silane resins are solidified on the operating face of the catcher 21. As a substitute for such resins, planar woods or papers may be solidified in mixture with bond.

Through addition of an attachment 65, 68, 69 or 70, the real silent distance Y' of a catcher 21' can be adjusted to the optimal silent distance Y. When a resultant real silent distance Y' is still larger than the optimal silent distance, the addition of attachment may be doubled.

The real silent distance Y' between the catcher 21 and the stopper 51 can be measured in various ways. Most simply, the real silent distance Y' is measured directly while keeping the stopper 51 in an operative position, i.e. a position not allowing string striking. This method, however, is rather poor in accuracy. It is also employable to measure a distance between the string 1 and the hammer 18 while keeping the stopper in the operative position. This method is again difficult to practice with high degree of accuracy.

Figure 5:
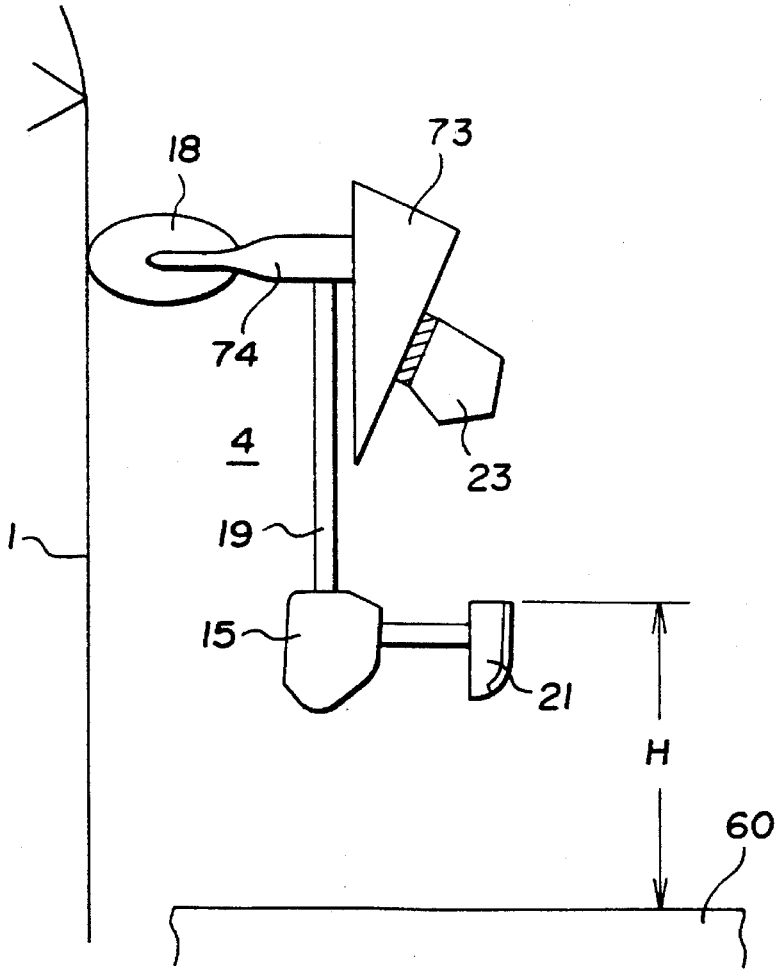
FIG. 5 is a side view for showing one method for adjusting the real silent distance in accordance with the present invention.

The method shown in FIG. 5 is preferably employed in practical measurement of the real silent distance Y' in an indirect fashion. The hammer 18 is kept in abutment against an associated string 1 and a height H from the key from 60 to the operating face of the catcher 21 is measured. Next, the hammer 18 is kept at a position of the let off distance D and a like height is again measured. A difference between the two heights corresponds to the real silent distance Y' between the catcher 21 and the stopper 51. For abutment of the hammer 18 with the string 1, a spacer 73 may be interposed between the hammer rail 23 and a hammer wood 74 as shown in FIG. 5. In an alternative, the hammer rail 23 is turned towards the string 1 in order to swing the hammer shank 19 towards the string 1.

Figure 6:
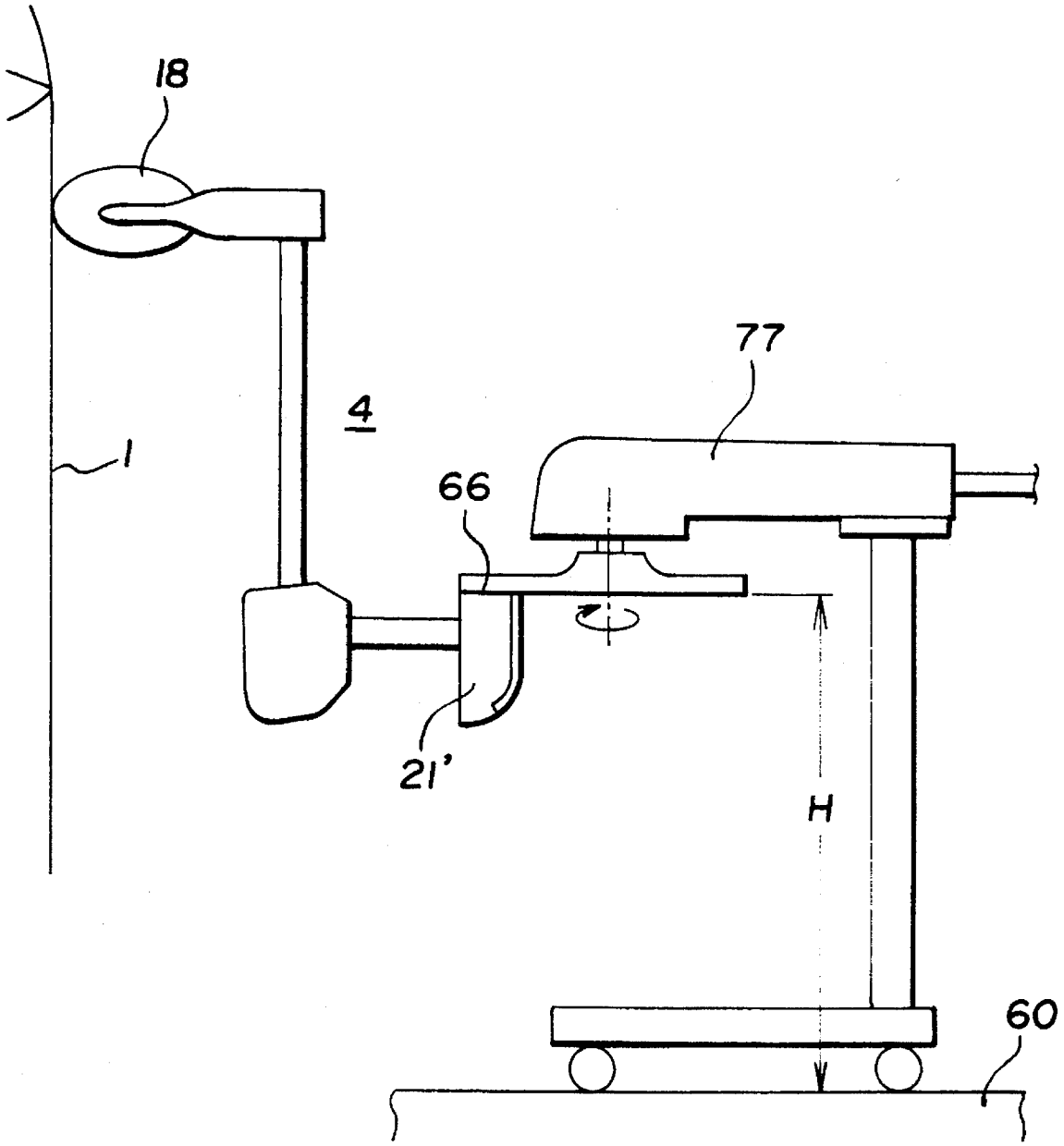
FIG. 6 is a side view for showing one method of thickness adjustment on each catcher.

The second type of adjustment will now be described in reference to FIGS. 5 and 6, in which the configuration of the catcher 21 is changed. More specifically, the operating face of the catcher 21 is somewhat removed. First, the hammer 18 are all kept in abutment against respective strings 1 in a manner such as shown in FIG. 5, and the real height H of the operating face of each catcher from the key 60 is measured. Catchers 21, whose height H is larger than the standard height which corresponds to the optimal silent distance Y, are sorted out. The operating face of such a catcher 21 is removed by a disc grinder 77 in order to make its real height H equal to the standard height. Other devices such as miller or sander may also be used for this adjusted removal of the operating face of the catcher 21. In the case of this method, the difference in silent distance is indirectly calculated through measurement of height. Catchers 21' of a real silent distance Y' smaller than the optimal silent distance Y are sorted out. The operating face of each sorted catchers 21' is removed over a depth equal to the the above-described difference in silent distance.

In practice, the first and second methods are preferably used in combination. More specifically, two groups of catchers 21 are sorted out after calculation of the difference in silent direction. The first group is made up of catchers 21' of real silent distances Y' larger than the optimal silent distance Y whereas the second group is made up of catchers 21' of real silent distances Y' smaller than the optical silent distance Y. Addition of the attachments is carried out for the catchers 21' of the first group and removal of the operating face is carried out for the catchers 21' of the second group.

Figure 7:
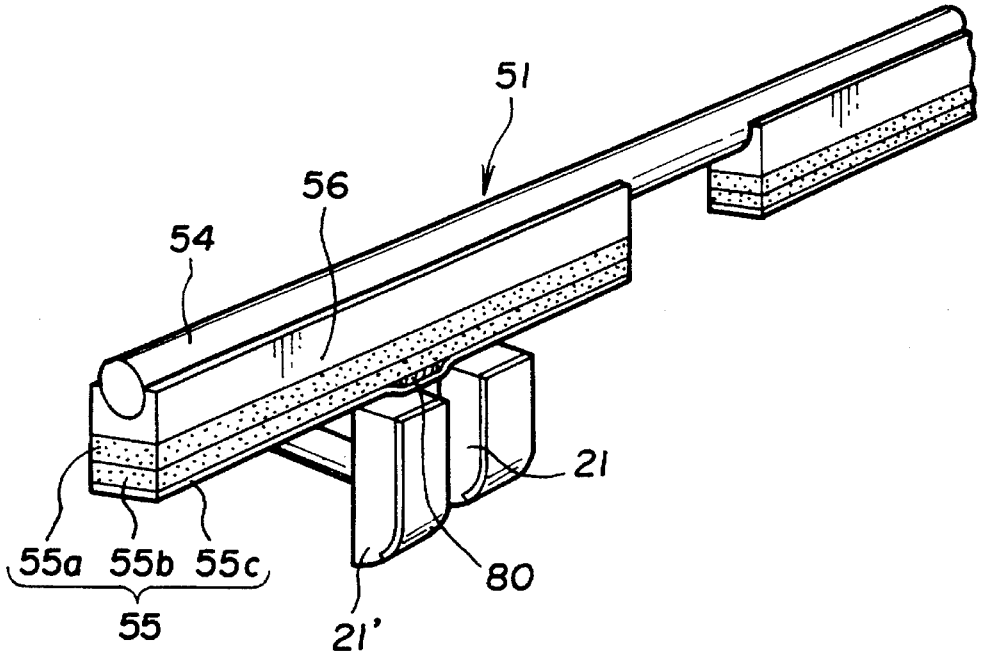
FIG. 7 is a side view for showing another method for adjusting the real silent distance in accordance with the present invention.
Figure 8:
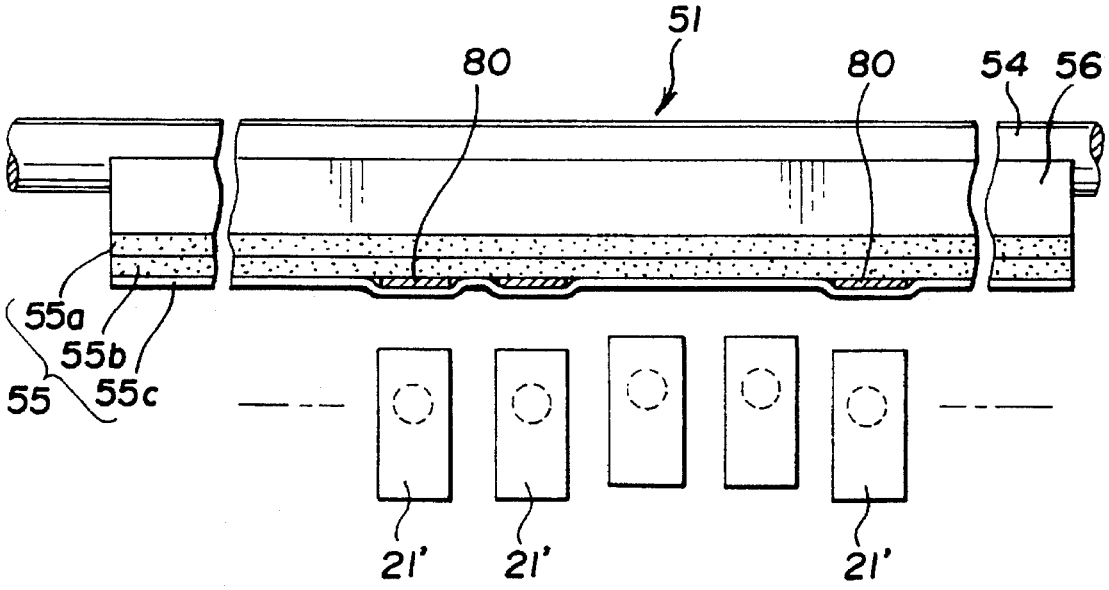
FIG. 8 is a top view of the same method.
Figure 9:
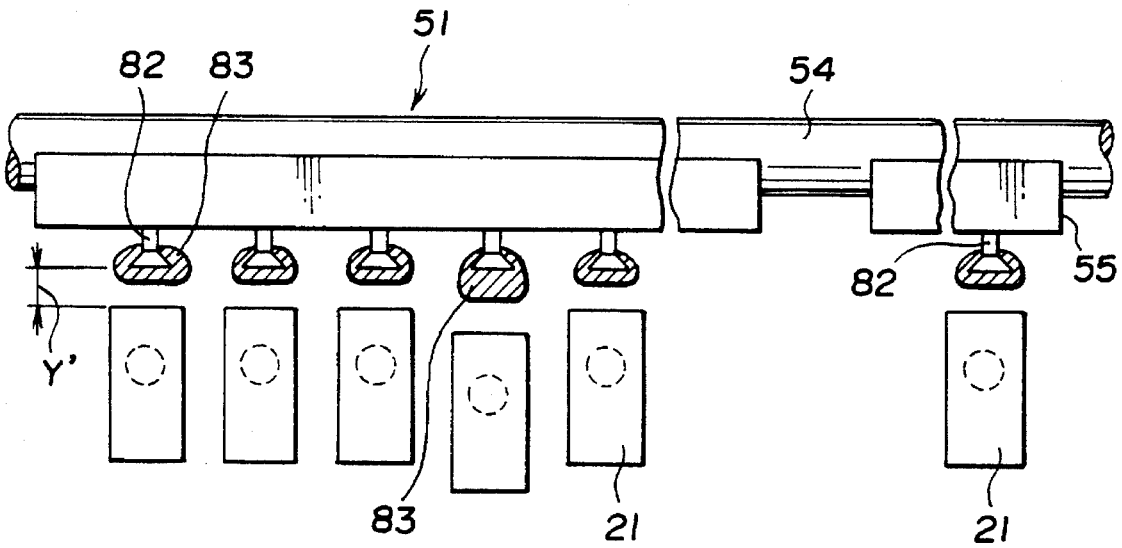
FIG. 9 is a top view, partly in section, for showing the other method for adjusting the real silent distance in accordance with the present invention.

The third type of adjustment will now be described in reference to FIGS. 7 and 8, in which one or more attachments are added to the stopper 51. The real silent distance Y' between each catcher 21 and the stopper 51 is measured in manners same as those employed in the first and second methods. Catchers 21' of real silent distances Y' larger than the optimal silent distance Y are sorted out. At a section on the stopper 51 corresponding to each sorted catcher 21', a planar adjuster piece 80 is inserted into the buffer unit 55 on the stopper 51. Here, the thickness of the adjuster piece 80 is equal to the difference in silent distance. Through insertion of such an adjuster piece 80, the resultant real silent distance between the sorted catcher 21' and the corresponding section of the stopper 51 is made equal to the optimal silent distance Y to minimize the let off distance D. Preferably, the adjuster piece 80 is made of rubber or felt and inserted between the outermost and middle components **55*c*, 55*b* of the buffer unit 55**.

In an alternative arrangement, screws 82 are secured to sections on the stopper 51 corresponding to the sorted catchers 21' and the head of each screw 82 is covered with a rubber cap 82 of a thickness equal to the corresponding difference in silent distance.

Figure 10:
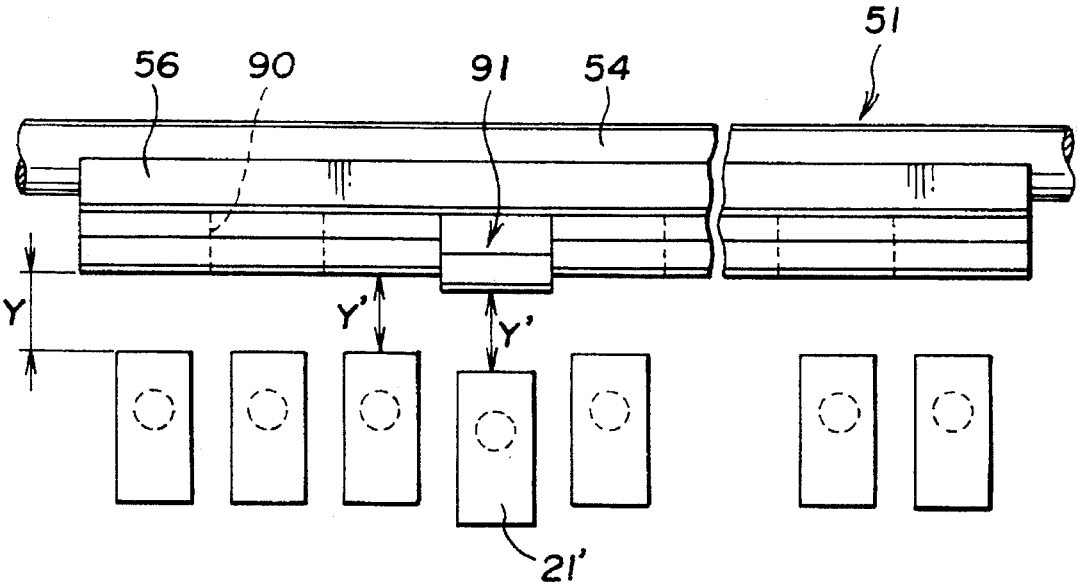
FIG. 10 is a top view for showing the other method for adjusting the real silent distance in accordance with the present invention.

The fourth type of adjustment will now be described in reference to FIGS. 10 and 11, in which a buffer element for the stopper 51 is partially interchanged. In the case of this system, slits 90 are formed in the buffer unit 55 on the stopper between adjacent segments each corresponding to a catcher 21 so that each section is respectively separable from the buffer unit 55. The real silent distance Y' between each catcher 21 and the stopper 51 is measured in manners same as those employed in the foregoing methods. Catchers 21' of real silent distances Y' larger than the optimal silent distance Y are sorted out. At a segment on the stopper 51 corresponding to each sorted catcher 21', the entire segment is interchanged with a new segment 91 of a thicker construction. Here, the difference in thickness between the old and new segments is equal to the difference in silent distance. The new section 91 is properly bonded to the base block 56.

Figure 11:
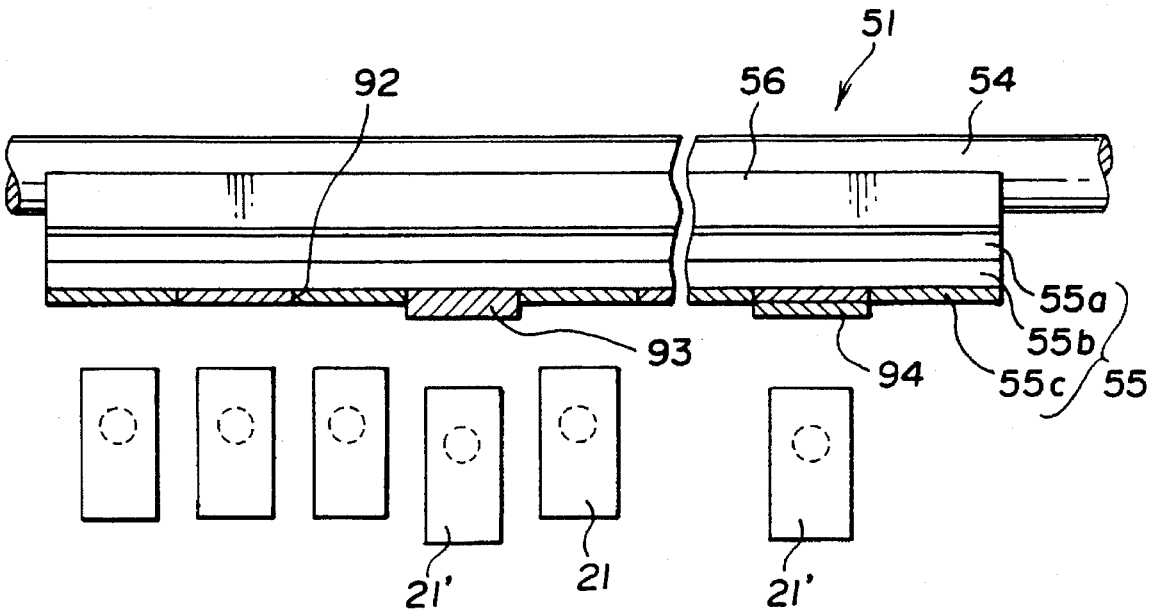
FIG. 11 is a top view, partly in section, for showing a modification of the method shown in, FIG. 12.

As a substitute for interchange of the entire segments, only the outermost component **55*c* of each segment can be interchanged with a thicker component 93 as shown in FIG. 11**.

In an alternative, catchers 21' of real silent distances smaller than the optimal silent distance Y are sorted out. At a segment on the stopper 51 corresponding to the each sorted catcher 21', the segment is entirely or partially interchanged with a new segment of a thinner construction. Here again, the difference in thickness between the old and new segments is equal to the difference in silent distance.

In the fifth type of adjustment, real silent distances Y' between the catchers 21 and the stopper 51 are all adjusted equal to the largest or smallest real silent distance via the above-described height adjustment. Next, the position of the silent shaft 54 carrying the stopper 51 is moved towards or away from the raw of the catchers 21 in order to make the largest or smaller real silent distance equal to the optimal silent distance.

Figure 12:
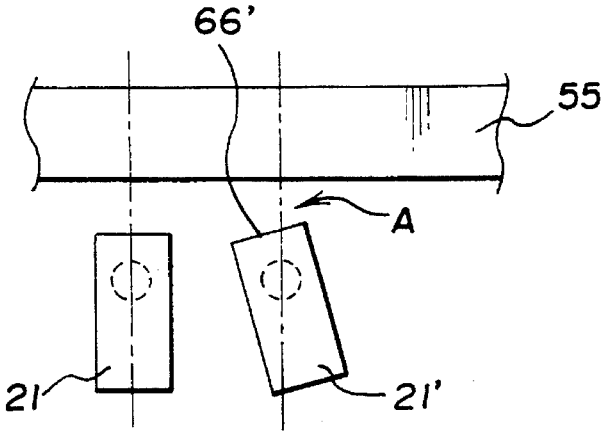
FIG. 12 is a top view of a catcher in misarrangement.
Figure 13:
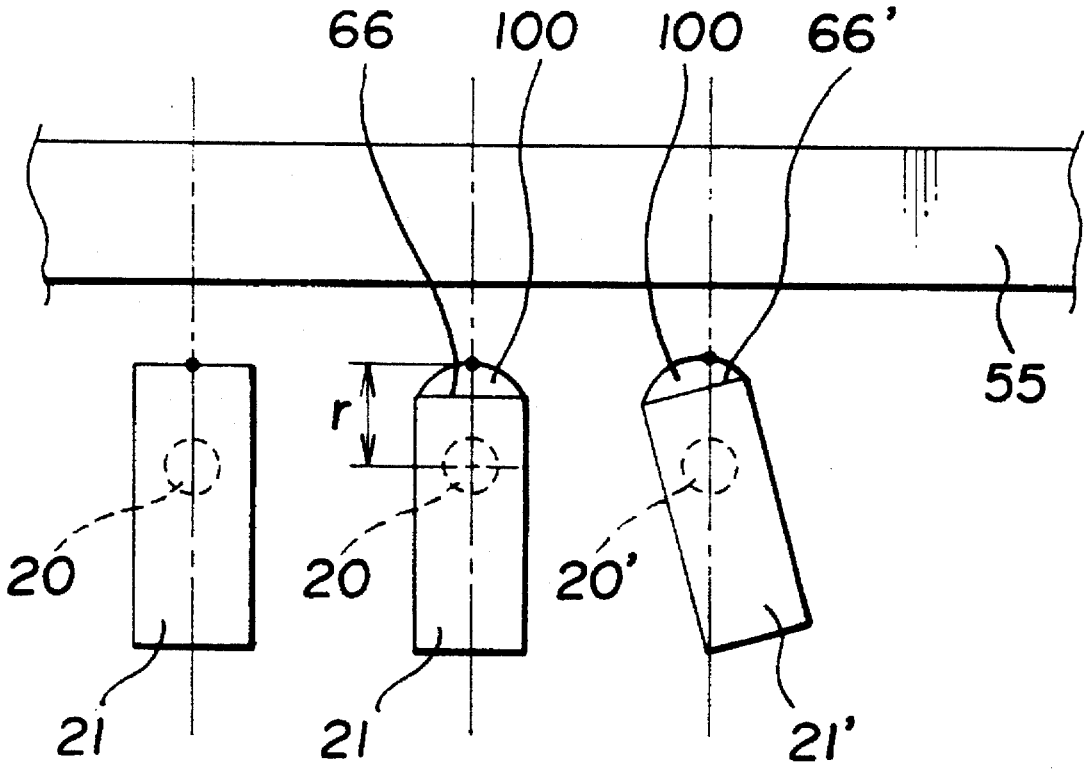
FIG. 13 is a top view for showing one example of the method for avoiding such a catcher misarrangement.

Next, a method for correcting misarrangement of a catcher 21 relative to the stopper 51 will now be described in reference to FIGS. 12 and 13. Here, the term "misarrangement of a catcher 21" refers to the position of the right side catcher 21' shown in FIG. 12. More specifically, this term refers to a position in which the operating face 66' of the catcher 21' is out of parallel to the associated face of the buffer unit 55 of a stopper 51. In this case, the operating face 66 of the catcher 21' is brought into oblique abutment against the associated face of the buffer unit 55. Such abnormal abutment applies a biased force to the hammer assembly 14 which is urged to vibrate or twist out of its correct position. Such abnormal action of the hammer assembly 14 tends to damage the butt flange 16 and/or cause undesirable contact with an adjacent hammer assembly, thereby generating harsh noises.

In order to prevents such troubles resulted from misarrangement of the catcher 21, an attachment 100 with a round face may be secured to the operating face 66' of a misarranged catcher 21'. The radius of curvature "r" of the round face on the attachment has its center on the geographical center of an associated catcher shank 20. Even when a catcher 21' is misarranged as shown on the right side in FIG. 13, the catcher 21' can be brought into normal abutment against the buffer unit 55 of the stopper 51. This mode of contact is fully same as that of the middle catcher 21 which is in the correct position. With this arrangement, neither damage on the butt flange 16 nor contact between hammer assemblies is caused by action of the hammer assembly 14.

As a result of the above-described adjustment of real silent distance in accordance with the present invention, the let off distance "D" of the hammers 18 relative to the associated strings 1 can be fairly minimized without any degradation in key touch feel. Since there is no change in real silent distance after the adjustment, the operation of the keyboard musical instrument is rendered quite reliable and durable. In addition, various methods of adjustment described are well adapted for application to pianos already on market without any difficulty in reformation.

I claim:

1. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of measuring a real silent distance between each said catcher and said stopper, calculating a difference between said real silent distance and an optimal silent distance, sorting out each catcher whose real silent distance is larger than said optimal silent distance, and covering an operating face of a sorted catcher with an adjuster strap of a thickness equal to said calculated difference in silent distance.

2. On a keyboard musical instrument provided with a plurality of action assemblies each including a swingable catcher add a hammer adapted for striking an associated string, and a silent assembly including a stopper adapted for prohibiting continued swing of said catchers just before string striking by said hammers, method for adjustment of hammer let off comprising the steps of measuring a real silent distance between each said catcher and said stopper, calculating a difference between said real silent distance and an optimal silent distance, sorting out each catcher whose real distance is smaller than said optimal silent distance, and removing an operating face of a sorted catcher over a depth equal to said calculated difference in silent distance.

3. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of measuring real silent distances between said catchers and said stopper, calculating differences between said real silent distances and an optimal silent distance, sorting out catchers of a first group whose real silent distances are larger than said optimal silent distance, sorting out catchers of a second group whose real silent distances are smaller than said optimal silent distance, covering operating faces of said catchers of said first group with adjuster straps of thicknesses equal to corresponding said differences in silent difference, and removing operating faces of said catchers of said second group over depths equal to corresponding said calculated differences in silent difference.

4. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of measuring a real silent distance between each said catcher and said stopper, calculating a difference between said real silent distance and an optimal silent distance, sorting out each catcher whose real silent distance is larger than said silent distance, and adding an adjuster piece of a thickness equal to said calculated difference in silent distance to a section on said stopper which corresponds to a sorted catcher.

5. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of dividing said stopper at least partially into a plurality of juxtaposed initial segments each corresponding to each said catcher, measuring a real silent distance between each said catcher and said stopper, calculating a difference between said real silent distance and an optimal silent distance, sorting out each said catcher whose real silent distance is larger than said optimal silent distance, and interchanging each said initial segment corresponding to a sorted catcher with a new segment of a thicker construction, a difference in thickness between said initial and new segments being equal to said calculated difference in silent distance.

6. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of dividing said catcher at least partially into a plurality of juxtaposed initial segments each corresponding to each said catcher, measuring a real silent distance between each said catcher and said stopper, calculating a difference between said real silent distance and an optimal silent distance, sorting out each said catcher whose real silent distance is smaller than said optimal silent distance, and interchanging each said initial segment corresponding to a sorted catcher with a new segment of a thinner construction, a difference in thickness between said initial and new segments being equal to said calculated difference in silent distance.

7. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of dividing said stopper at least partially into a plurality of juxtaposed initial segments each corresponding to each said catcher, measuring real silent distances between said catchers and said stopper, calculating differences between said real silent distances and an optimal silent distance, sorting out catchers of a first group whose real silent distances are larger than said optimal silent distance, sorting out catchers of a second group whose real silent distances are smaller than said optimal silent distance, interchanging said initial segments corresponding to said sorted catchers of said first group with new segments of thicker constructions, differences in thickness between said initial segments and said new segments being equal to said differences in silent distance respectively, and interchanging said initial segments corresponding to said catchers of said second group with new segments of thinner constructions, differences in thickness between said initial segments and said new segments being equal to said calculated differences in silent distance, respectively.

8. On a keyboard musical instrument provided with a plurality of action assemblies each including a swingable catcher and a hammer adapted for striking an associated string, and a silent assembly including a stopper adapted for prohibiting continued swing of said catchers just before string striking by said hammers, method for adjustment of hammer let off comprising the steps of measuring real silent distances between said catchers and said stopper, adjusting all of said real silent distances to one of maximum and minimum real silent distances so that all the catchers should have a uniform real silent distance, and moving said stopper relative to a raw of said catchers to make said uniform real silent distance equal to an optional silent distance.

* * * * *